US009599084B2

(12) United States Patent
Kochanowski et al.

(10) Patent No.: US 9,599,084 B2
(45) Date of Patent: Mar. 21, 2017

(54) FUEL INJECTOR

(71) Applicant: Robert Bosch GmbH, Stuttgart (DE)

(72) Inventors: Martin Kochanowski, Moeglingen (DE); Detlef Nowak, Heilbronn (DE); Guido Pilgram, Gundelsheim (DE); Rainer Ecker, Kornwestheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/404,724

(22) PCT Filed: May 24, 2013

(86) PCT No.: PCT/EP2013/060757

§ 371 (c)(1),
(2) Date: Dec. 1, 2014

(87) PCT Pub. No.: WO2013/178549

PCT Pub. Date: Dec. 5, 2013

(65) Prior Publication Data

US 2015/0115068 A1 Apr. 30, 2015

(30) Foreign Application Priority Data

Jun. 1, 2012 (DE) ..... 10 2012 209 326

(51) Int. Cl.
*F02M 67/12* (2006.01)
*F02M 51/06* (2006.01)
(Continued)

(52) U.S. Cl.
CPC ..... *F02M 67/12* (2013.01); *F02B 17/005* (2013.01); *F02M 51/0671* (2013.01);
(Continued)

(58) Field of Classification Search
CPC ..... F02M 67/12; F02M 51/0671; F02M 61/1833; F02M 61/1813; F02M 2200/06
(Continued)

(56) References Cited

U.S. PATENT DOCUMENTS 4,245,789 A * 1/1981 Gray ..... F02M 51/0614 239/463
4,650,122 A * 3/1987 Kienzle ..... F02M 51/061 239/497
(Continued)

FOREIGN PATENT DOCUMENTS

DE 101 24 748 2/2003
DE 10 2008 001949 11/2008
(Continued)

OTHER PUBLICATIONS

International Search Report for PCT/EP2013/060757, dated Aug. 9, 2013.

*Primary Examiner* — Arthur O Hall
*Assistant Examiner* — Joseph A Greenlund
(74) *Attorney, Agent, or Firm* — Gerard Messina

(57) ABSTRACT

A fuel injector configured as a high-pressure injection valve for the direct injection of fuel into a combustion chamber includes: a housing having an housing end face on the combustion chamber side; an actuator; a valve-closure member operable by the actuator; at least one outlet orifice in the housing end face on the combustion chamber side for the fuel, the valve-closure member selectively closing or opening the outlet orifice; and a ring provided round about the outlet orifice in the housing end face on the combustion chamber side.

9 Claims, 4 Drawing Sheets

(51) Int. Cl.
*F02M 61/18* (2006.01)
*F02B 17/00* (2006.01)
*F02B 75/12* (2006.01)

(52) U.S. Cl.
CPC .... *F02M 61/1813* (2013.01); *F02M 61/1833* (2013.01); *F02B 2075/125* (2013.01); *F02M 2200/06* (2013.01)

(58) Field of Classification Search
USPC ..... 239/533.12, 584, 601, 585.1, 585.4, 239/585.5, 590; 123/299
See application file for complete search history.

(56) References Cited

U.S. PATENT DOCUMENTS 4,890,794 A * 1/1990 Imafuku ..... F02M 51/0678 239/533.12
5,752,316 A * 5/1998 Takagi ..... B23P 15/16 29/888.4
6,092,741 A * 7/2000 Sumida ..... F02M 51/0671 239/408
6,092,743 A * 7/2000 Shibata ..... F02B 17/005 239/533.12
6,273,349 B1 * 8/2001 Fischbach ..... F02M 51/0671 239/494
6,382,533 B1 * 5/2002 Mueller ..... F02M 51/061 239/585.1
6,585,175 B2 * 7/2003 Takeuchi ..... B05B 1/00 239/601
6,736,104 B2 * 5/2004 Maier ..... F02M 61/184 123/305
7,011,257 B2 * 3/2006 Heyse ..... F02M 51/0671 239/533.12
7,306,173 B2 * 12/2007 Pilgram ..... F02M 51/0664 239/288
7,438,241 B2 * 10/2008 Goenka ..... F02M 61/1853 239/500
7,677,478 B2 * 3/2010 Maier ..... F02M 51/0671 239/533.12
7,712,680 B2 * 5/2010 Berger ..... B05B 17/0623 239/102.2
8,016,214 B2 * 9/2011 Higuma ..... B21K 1/20 239/533.12
8,191,800 B2 * 6/2012 Kitagawa ..... F02M 51/061 239/533.12
8,360,338 B2 * 1/2013 Gunji ..... F02M 61/168 239/5
8,672,239 B2 * 3/2014 Ogura ..... F02M 61/1846 239/533.12
2007/0095952 A1 * 5/2007 Heinstein ..... F02M 51/0671 239/585.1
2014/0151468 A1 * 6/2014 Yasukawa ..... F02M 61/1813 239/562

FOREIGN PATENT DOCUMENTS

JP S61-41086 A 2/1986
JP H04-246274 A 9/1992
JP 2005-098160 A 4/2005
WO WO 02/084104 10/2002

* cited by examiner

FUEL INJECTOR

BACKGROUND OF THE INVENTION

1. Field of the Invention

The present invention relates to a fuel injector, e.g., a high-pressure injection valve for the direct injection of fuel into a combustion chamber.

2. Description of the Related Art

In known high-pressure injection valves, particularly those having multipole preparation, the fuel is sprayed into the combustion chamber through spray orifices and pre-stage chambers. In this context, on the combustion chamber side, the pre-stage chamber ends flush with the end face of the housing of the injection valve facing the combustion chamber. This end face is also known as an injector tip. Each injection leads to a wetting of the region of the end face that is close to the pre-stage region of the end face and to increased particulate emission. In the process, fuel residues polymerize and form a porous layer while merging with the soot particles formed in the combustion chamber. In subsequent injection processes, this porous layer acts like a "sponge" for the fuel and leads to vaporization and particle generation in the vacuum phase subsequent to the compression.

BRIEF SUMMARY OF THE INVENTION

The fuel injector according to the present invention provides a ring on the injector tip, on the combustion chamber side of the pre-stage chamber. Because of that, the area wetted by fuel is drastically reduced, and by a sharp-edged embodiment of the ring, the fuel lamella remaining in the spray orifice and the pre-stage chamber is "cut off" and, during the closing process of the outlet orifice, it is retracted into the fuel injector again. The remaining mass is reduced because of that. The deposits on the end face of the ring may easily be blown away by the combustion chamber flow. The ring applied on has a relatively small mass, and is consequently able to be greatly heated up, so that a rapid vaporization of remaining fuel residues takes place in the deposits, whereby, in turn, the particulate formation is drastically reduced. All these advantages are achieved by the fuel injector according to the present invention. In particular, this involves a high-pressure injection valve for the direct injection of fuel into a combustion chamber. The injection valve includes (i) a housing having an end face on the combustion chamber side, (ii) an actuator, (iii) a valve-closure member that is operable by the actuator, and (iv) at least one outlet orifice in the housing end face for the fuel. Using the actuator, the valve-closure member is moved in such a way that it optionally closes or opens the outlet orifice. According to the present invention, on the combustion chamber side, round about the outlet orifice, a ring is developed on the housing end face on the combustion chamber side. This ring is particularly an integral component of the housing. The ring may also be characterized as a bead, an embankment or a collar. The ring, or the end face of the ring, represents a very small area for the depositing of fuel, so that problems mentioned at the outset are avoided, to a great extent.

The housing end face on the combustion chamber side, or rather facing the combustion chamber, in which the outlet orifice is developed, is particularly shaped as a dome. The dome shape extends in the direction of the combustion chamber, in this instance. The advantage of this dome-shaped design is that a plurality of outlet orifices are able to be developed on the dome shape in a distributed manner. The valve-closure member is particularly configured in such a way that, depending on its position, it simultaneously closes all the outlet orifices or opens all the outlet orifices. It is particularly preferably provided that a ring according to the present invention be situated at each of the outlet orifices.

In an advantageous development, the outlet orifice is made up of a spray orifice having a first diameter and a pre-stage chamber adjacent to the spray orifice on the combustion chamber side having a second diameter.

The second diameter is larger than first diameter, in this instance. That is, the fuel is injected through the spray orifice into the pre-stage chamber. From this pre-stage chamber, the fuel moves on into the combustion chamber of the internal combustion engine. Indeed, in the case of the development of the outlet orifice having a spray orifice and a downstream pre-stage chamber, the problem exists, in previously known systems, of deposits of fuel on the housing end face that faces the combustion chamber. That is why in this case, the ring according to the present invention is advantageously used on the combustion chamber side of the pre-stage chamber.

For the inside diameter of the ring, there are two preferred variants. On the one hand, the inside diameter of the ring may be equal to the second diameter. In this case, the ring represents an elongation of the pre-stage chamber without offsets.

It is alternatively possible that the inside diameter of the ring is larger than the second diameter. In this case, there is a step or a shoulder at the transition of the pre-stage chamber to the inside space of the ring.

The ring has an end face on the combustion chamber side or facing the combustion chamber. It is on this end face of the ring that a deposit of fuel will occur. In order to avoid this deposit to a great extent, the wall thickness of the ring is selected to be as small as possible. In addition, it is advantageous for the blowing away of the deposits if the ring end face is inclined. If the housing end face facing the combustion chamber is perpendicular to the longitudinal axis of the fuel injector, the inclination of the ring end face may be specified directly with reference to the housing end face. In a preferred development, it is provided, however, that the housing end face is developed to be dome-shaped. In the dome-shaped development, there is a tangential area of the housing end face. This tangential area is formed by the tangent family at the dome-shaped housing end face. The inclination of the ring end face may accordingly be specified with reference to the tangential area.

It is preferably provided that the entire ring area have an inclination with respect to the housing end face or the tangential area. The angle of inclination preferably amounts to at least 5°, especially preferably at least 10°. The ring end face is particularly inclined outwards. This means that the ring is higher inside than outside.

Alternatively, it is possible to design the ring end face as a gable roof shape, as seen in cross section. In that case, the ring end face is subdivided into two annular subareas that form an angle with respect to each other. In this case, too, it is preferably provided to make the angle of inclination of the individual subareas at least 5°, preferably at least 0°.

Furthermore, the wall thickness of the ring is held to as low as possible, so as to avoid deposits. The wall thickness should be particularly between 0.1 mm and 0.3 mm.

A sufficient height of the ring has to ensure that the fuel deposits on the ring end face, but not on the surrounding housing end face. Therefore, the ring should extend by 0.1 mm to 0.5 mm beyond the housing end face.

DETAILED DESCRIPTION OF THE INVENTION

Figure 1:
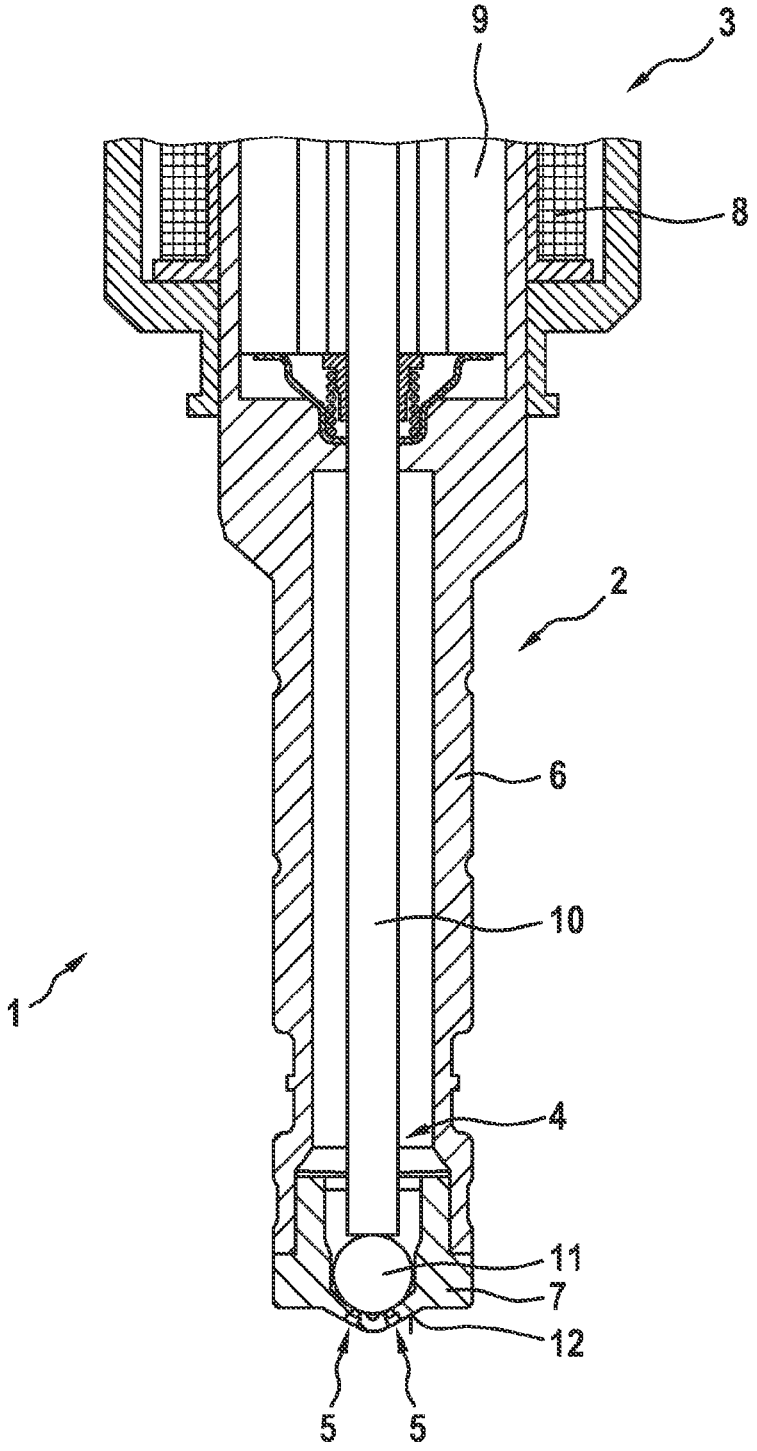
FIG. 1 showsa sectional view of a fuel injector according to the present invention, according to all the exemplary embodiments.

FIG. 1 shows a sectional view of a fuel injector 1 according to the present invention. Fuel injector 1 is developed as a high-pressure injection valve for the direct injection of fuel into a combustion chamber. FIG. 1 illustrates the structure for all the exemplary embodiments.

Fuel injector 1 includes a housing 2, an actuator 3, a valve-closure member 4 and a plurality of outlet orifices 5. Housing 2 is made up of a base element 6 and an insert 7 on the combustion chamber side. The side of insert 7 facing the combustion chamber is designated as housing end face 12. In this housing end face 12 are situated the plurality of outlet orifices 5.

Actuator 3 includes a coil 8, that is able to be supplied with current, and a core 9. By supplying current to coil 8, valve-closure member 4 is moved via armature 9. Valve-closure member 4 includes a needle 10 and a ball 11. At the appropriate position of needle 10, ball 11 simultaneously closes all the outlet orifices 5.

In FIGS. 2 through 7 an outlet orifice is in each case bordered by a broken line. This bordered outlet orifice shows a comparative example 14 as in the related art. Actually, all outlet orifices 5 are developed on housing end face 12, according to the present invention.

Identical components or functionally identical components are designated by identical reference symbols in the exemplary embodiments.

Figure 2:
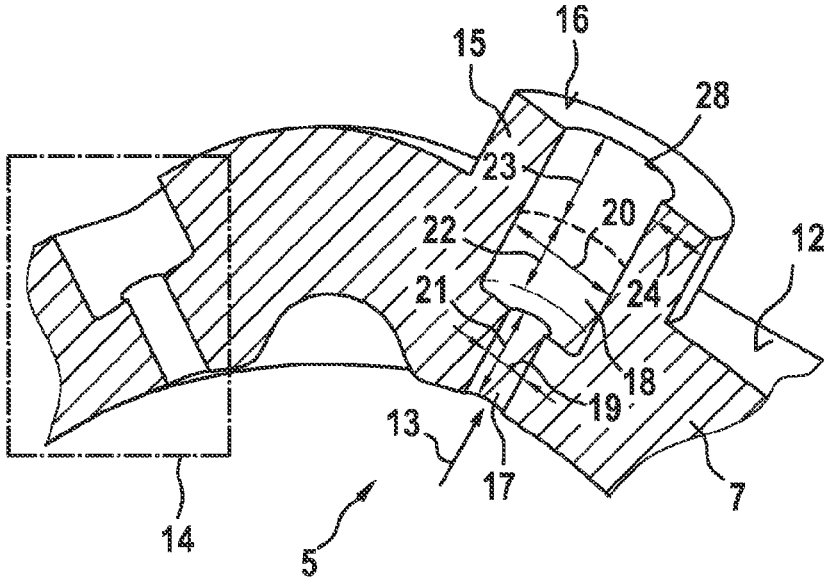
FIG. 2 shows a detail of a fuel injector according to the present invention according to a first exemplary embodiment.

FIG. 2 shows a detail of fuel injector 1 according to a first exemplary embodiment. A cutout of housing end face 12 is shown facing the combustion chamber. This housing end face 12 is designed to be dome-shaped. One of the plurality of outlet orifices 5 is shown. The combustion chamber is located in the upper region, and accordingly, an injection direction 13 for the fuel is drawn in.

Outlet orifice 5 is composed of a spray orifice 17 and a pre-stage chamber 18. Pre-stage chamber 18 is situated on the combustion chamber side of spray orifice 17. On the combustion chamber side of pre-stage chamber 18, a ring 15 is located on housing end face 12. Ring 15 is an integral component of housing 2, particularly of insert 7. Ring 15 has a ring end face 16 on the combustion chamber side. The edge at the transition to ring end face 16 is designated as edge 28. This edge 28 is developed as sharp-edged as possible, in order to achieve a tearing off of the flow at this point.

Spray orifice 17 has a first diameter 19. Pre-stage chamber 18 has a second diameter 20. Spray orifice 17 extends over a first length 21. Pre-stage chamber 18 extends over a first length 22. The inner space of ring 15 extends over a third length 23. Ring 15 has a wall thickness 24.

In the first exemplary embodiment, second diameter 20 corresponds to the inside diameter of ring 15. Moreover, second diameter 20 is developed substantially larger than first diameter 19.

Wall thickness 24 is developed as small as possible, preferably between 0.1 mm and 0.3 mm, in order to avoid deposit of the fuel on ring end face 16 to the greatest extent.

Third length 23 is between 0.1 mm and 0.5 mm.

Figure 3:
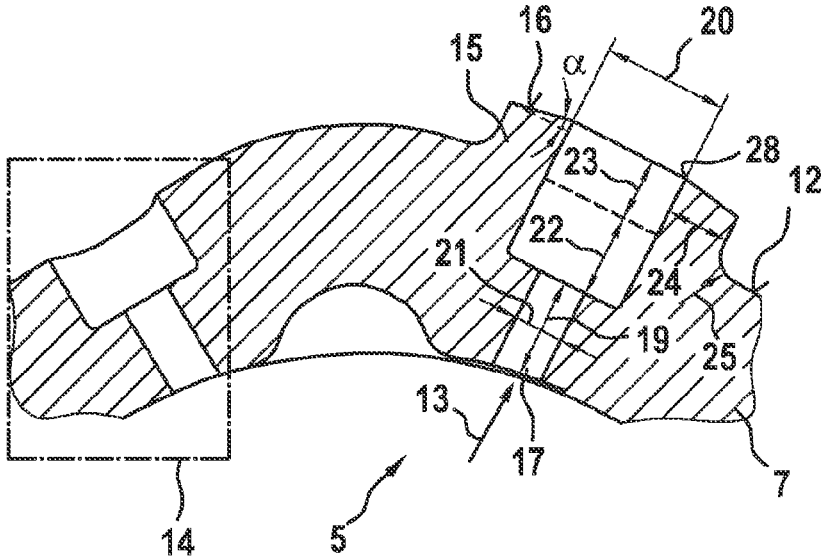
FIG. 3 shows a detail of a fuel injector according to the present invention according to a second exemplary embodiment.

FIG. 3 shows in detail a second exemplary embodiment of fuel injector 1. By contrast to the first exemplary embodiment, in the second exemplary embodiment, ring end face 16 is inclined with respect to the tangential area towards housing end face 12 by an angle $\alpha$. Angle $\alpha$ is about 10° in this case. Ring end face 16 is inclined outwards. This improves the blowing away of deposits on ring end face 16. Furthermore, FIG. 3 shows a radius 15 at the transition from ring 15 to housing end face 12.

Figure 4:
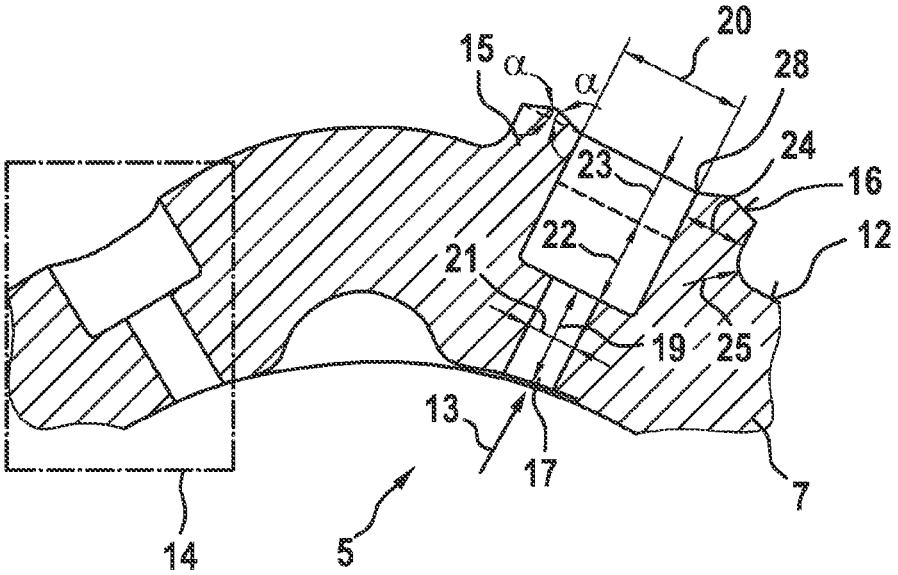
FIGS. 4 and 5 show details of a fuel injector of the present invention according to a third exemplary embodiment.
Figure 5:
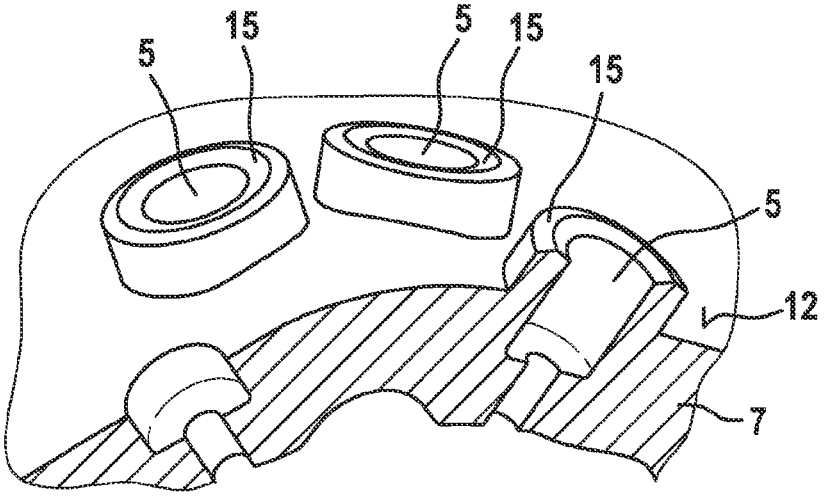

FIGS. 4 and 5 show a detail of fuel injector 1 according to a third specific embodiment. By contrast to the first exemplary embodiment, in the third exemplary embodiment, ring end face 16 is not developed in parallel to the tangential area of housing end face 12. In the third exemplary embodiment, ring end face 16 is gable roof-shaped, as seen in cross section. The two subareas of ring end face 16 are inclined by an angle $\alpha$, so that the peak, or rather the gable roof shape is created. This development of ring end face 16 promotes the blowing away of deposits.

Figure 6:
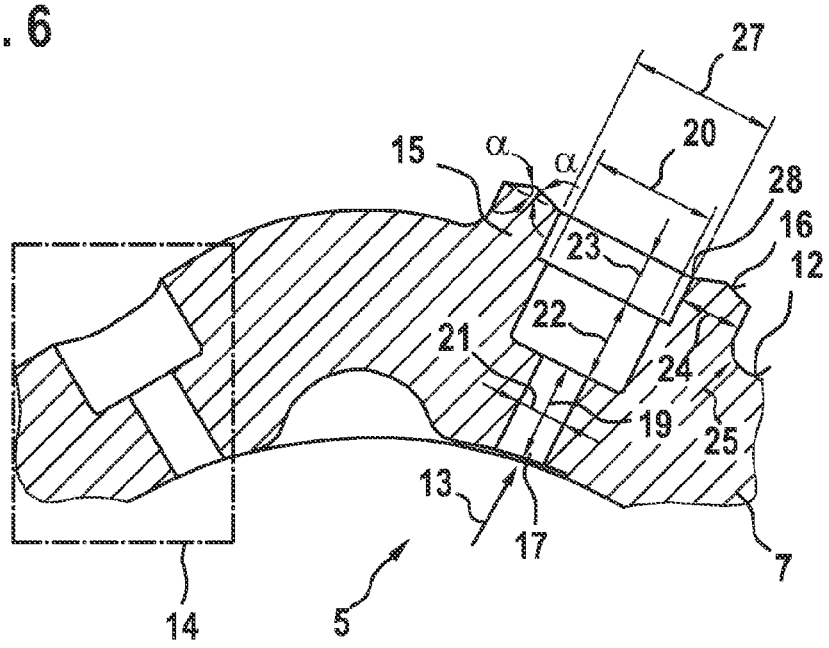
FIGS. 6 and 7 show details of a fuel injector of the present invention according to a fourth exemplary embodiment.
Figure 7:
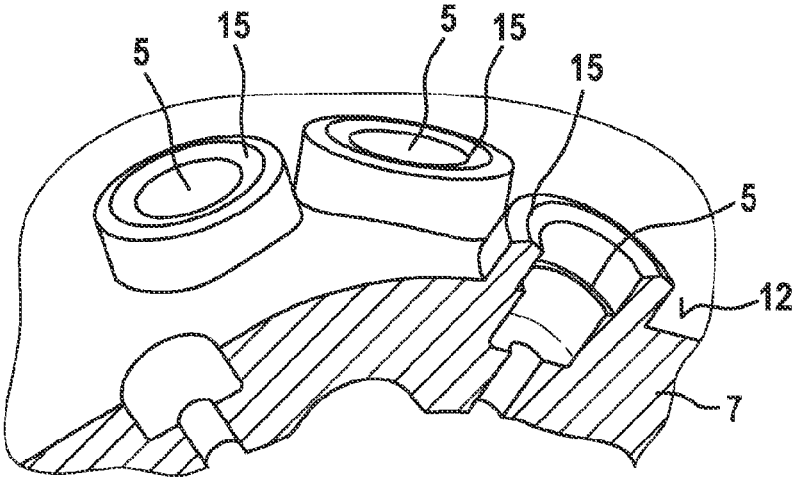

FIGS. 6 and 7 show fuel injector 1 according to a fourth specific embodiment. In the fourth exemplary embodiment, ring end face 16 is gable roof-shaped, as in the third exemplary embodiment. Furthermore, in the fourth exemplary embodiment, an inside diameter 27 of ring 15 is enlarged. Inside diameter 27 is thus larger than second diameter 20. This creates a step or a shoulder at the transition from pre-stage chamber 18 to the inner space of ring 15.

This different development of the inside diameter at ring 15 and pre-stage chamber 18, and the edge thereby created at the transition may advantageously be used on all the exemplary embodiments, and is not dependent upon the gable roof-shaped embodiment of ring end face 16.

What is claimed is:

1. A fuel injector configured as a high-pressure injection valve for direct injection of fuel into a combustion chamber, comprising:

a housing having a housing end face on the combustion chamber side, wherein at least one outlet orifice is provided in the housing end face for the fuel;

an actuator;

a valve-closure member operable by the actuator, wherein the valve-closure member is configured to selectively close and open the outlet orifice; and a ring provided round about the outlet orifice on the housing end face on the combustion chamber side;

wherein, with respect to each of at least one of the at least one outlet orifice:

the respective outlet orifice includes (a) a spray orifice and (b) a pre-stage chamber that extends from the spray orifice to a terminal edge of the respective outlet orifice on the combustion chamber side of the respective outlet orifice;

the terminal edge is formed by the housing end face, which extends away from the terminal edge inside the ring;

the spray orifice has a first diameter;

the pre-stage chamber has a second diameter that is larger than the first diameter;

an inside of the ring has a third diameter that is larger than the second diameter;

a transition from the first diameter to the second diameter:

(a) occurs below the housing end face within a thickness of the housing, the ring extending above the housing end face; and (b) defines a first stepped cross-sectional profile, defining a first surface that is approximately perpendicular to a longitudinal extension of the respective spray orifice, the surface being located at a transition from the respective spray orifice to the pre-stage chamber;

a transition from the second diameter to the third diameter coincides with the extension of the housing end face away from the terminal edge inside the ring, which extension defines a second stepped cross-sectional profile, defining a second surface that is approximately perpendicular to the longitudinal extension of the respective spray orifice; and the second surface that is approximately perpendicular to the longitudinal extension of the respective spray orifice continues on an outside of the ring, the ring thereby interrupting between a first region of the second surface that is on the outside of the ring and that is approximately perpendicular to the longitudinal extension of the respective spray orifice and a second region of the second surface that is inside the ring and that is approximately perpendicular to the longitudinal extension.

2. The fuel injector as recited in claim 1, wherein the housing end face on the combustion chamber side is dome-shaped.

3. The fuel injector as recited in claim 1, wherein the at least one outlet orifice includes a plurality of outlet orifices on the housing end face on the combustion chamber side, each having a ring.

4. The fuel injector as recited in claim 1, wherein a ring end face of the ring on the combustion chamber side is situated one of (i) parallel to the housing end face or (ii) parallel to the tangential area of the housing end face.

5. The fuel injector as recited in claim 1, wherein a ring end face of the ring on the combustion chamber side is one of (i) inclined with respect to the housing end face or (ii) inclined with respect to the tangential area of the housing end face.

6. The fuel injector as recited in claim 5, wherein the ring end face of the ring on the combustion chamber side is gable roof-shaped in cross section.

7. The fuel injector as recited in claim 5, wherein the ring end face of the ring on the combustion chamber side is one of (i) inclined with respect to the housing end face or (ii) inclined with respect to the tangential area of the housing end face by at least 10°.

8. The fuel injector as recited in claim 5, wherein the wall thickness of the ring is between 0.1 mm and 0.3 mm.

9. The fuel injector as recited in claim 5, wherein the ring extends by 0.1 mm to 0.5 mm beyond the housing end face.

* * * * *